United States Patent [19]

Ono

[11] 3,947,659

[45] Mar. 30, 1976

[54] HAIR DRYER WITH A VAPOR EJECTION MEANS

[75] Inventor: Takamichi Ono, Yokohama, Japan

[73] Assignee: Takashi Tumura, Tokyo, Japan

[22] Filed: July 15, 1974

[21] Appl. No.: 488,323

[30] Foreign Application Priority Data

Feb. 14, 1973 Japan ..... 49-17131

[52] U.S. Cl. ..... 219/362; 34/91; 34/97; 132/7; 219/272; 219/273; 219/364; 219/370

[51] Int. Cl.[2].. H05B 1/00; A45D 20/08; F24H 3/04

[58] Field of Search ..... 219/362, 271–276, 219/359, 361, 369–371; 34/91, 96–101, 243; 132/7, 9, 116, 118, 112

[56] References Cited

UNITED STATES PATENTS

| | | | |
|---|---|---|---|
| 2,217,729 | 10/1940 | Chancey | 219/222 X |
| 2,319,352 | 5/1943 | Smernis | 219/273 UX |
| 2,850,615 | 9/1958 | Luse et al. | 219/271 X |
| 3,004,540 | 10/1961 | Ronzi | 34/99 X |
| 3,612,069 | 10/1971 | Waters | 219/275 UX |
| 3,721,250 | 3/1973 | Walter et al. | 219/275 UX |
| 3,727,322 | 4/1973 | Walter et al. | 219/275 UX |
| 3,745,306 | 7/1973 | Naritomi | 219/275 X |
| 3,781,519 | 12/1973 | Martin et al. | 219/276 X |
| 3,800,810 | 4/1974 | Mercer | 219/272 UX |
| 3,814,898 | 6/1974 | Levine | 219/362 |

*Primary Examiner*—A. Bartis

*Attorney, Agent, or Firm*—George B. Oujevolk

[57] ABSTRACT

A hair dryer with a vapor ejection means, the vapor ejection means includes a vapor nozzle, a tank adapted to contain liquid therein, an evaporation chamber heated by a heater and a feeder for feeding the liquid from the tank into the evaporation chamber. Formation of hot drops is prevented by longitudinal inner and outer nozzles, each with a separate discharge ends in the vapor nozzle, both with nozzle outer ends. The inner nozzle is longitudinally within the outer nozzle, the discharge end of said inner nozzle being inward from, and separate from the discharge end of the outer nozzle. In both the nozzle discharge ends there are inwardly disposed annular recesses to prevent liquid drops from falling from the outer nozzle outer end.

2 Claims, 5 Drawing Figures

HAIR DRYER WITH A VAPOR EJECTION MEANS

BACKGROUND OF THE INVENTION

The present invention relates to a hair dryer with a vapor ejection means, and more particularly to a compact unit for vapor ejection.

BRIEF DESCRIPTION OF THE PRIOR ART

Heretofore, a water tank was attached to a hair dryer. Vapor was produced by directly heating the water in the tank means by means of a heater. The vapor produced was made to be ejected through a nozzle of the dryer. However, in the case of a hair dryer with above-mentioned structure, since the heating had to be continued until all the water inside the tank became boiling hot, not only the production of vapor required much time, but also the power consumption was considerable; in addition, it was wasteful that hot water remained in the tank, even after its use. Moreover, as the temperature in the circumference of the tank became high due to heating, there was a possibility of failure in the inside. Furthermore, there was always some risk during use because of the fact that hot water drops, together with the vapor, fell from the nozzle and were liable to scatter in all directions.

OBJECTS OF THE INVENTION

The object of the invention is to provide a hair dryer with a vapor ejection means that does away with the conventional defects and that is capable of producing vapor instantly at the time of its use; that consumes little electric power; and has been designed to eliminate a possibility of internal failure due to heating for the production of vapor; that blows off vapor only, there being no apprehension during its application of the scattering of the effluence of hot water drops from the nozzle, in other words, the hair dryer that can be used with assurance and safety.

SUMMARY OF THE INVENTION

According to this invention, the hair dryer with a vapor ejection means, herein contemplated, includes a tank that is so made as to contain liquid within it, an evaporation chamber designed to be heated by a heater, a feeder that supplies the liquid from the tank to the evaporation chamber, and a double nozzle coupled to the evaporation chamber.

The invention and other objects and advantages thereof will become apparent by referring to the attached drawings, and from the following detailed description, in which:

DETAILED DESCRIPTION

Figure 1:
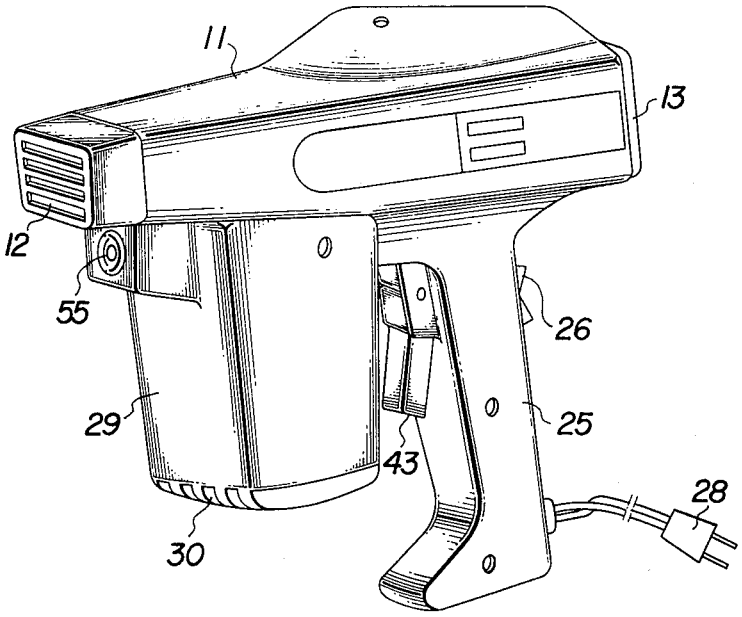
FIG. 1 is an oblique view of a hair dryer with a vapor ejection means according to one example of application of this invention.
Figure 2:
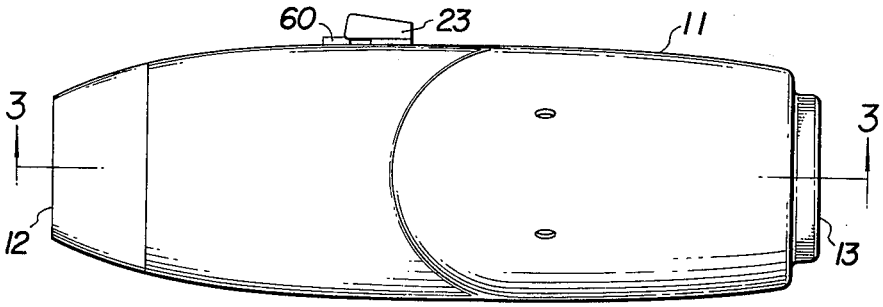
FIG. 2 is a plan view of the hair dryer.
Figure 3:
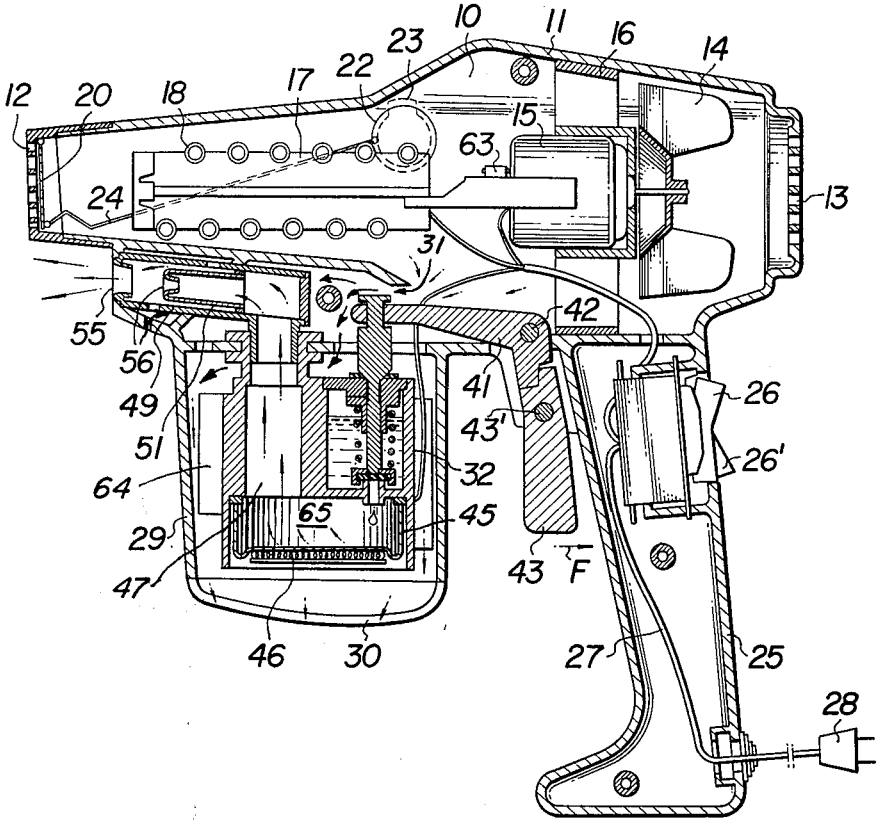
FIG. 3 is a cross-sectional view along the line 3—3 of the dryer shown in FIG. 2.

In the preferred embodiment of this invention, as shown in the attached drawings, the dryer chamber 10 is built up of a cylindrical dryer wall 11, there being provided in its front end a main nozzle 12 through which air is blown off and a suction port 13 at the rear end. In the rear of the dryer chamber 10, there is fixed with a frame 16 the motor 15 provided with a fan 14 while in the front of the dryer chamber 10, there is a heater holder 17, a NICHROME wire or a heater 18. The above-mentioned unit is similar to the conventional technique.

On the inner side of the afore-mentioned main nozzle 12 is the upper end of the shutter 20 being rotatably coupled to a shaft 21. On the inner surface of one side of the dryer wall 11 is a working plate 22 with a knob 23 on the outside through the dryer wall 11 for operating the working plate. A coupling member 24 has one end which is rotatably coupled to the end of underside of the afore-mentioned shutter 20 while the other end is rotatably linked to the circumference of the working plate 22, it is being so constructed that by turning the knob 23, not only the shutter 20 is rotated approximately 90° but also the shutter may be kept either in the open state or in the closed condition.

On the underside in the rear of the dryer wall 11 is a handle 25 with a pair of switches 26 and 26' on the inside. There is also a lead wire 27 and a plug 28 for connecting to a power outlet.

On the underside in front of the dryer wall 11 is a cover 29, and a ventilating outlet 30 on the underside with a ventilating port 31 on the upper side so as to connect to the dryer chamber.

Inside the cover 29 is tank 32 that has been so designed as to contain liquid or water and can receive water from the outside of the cover 29 by opening the cap 60 provided for the purpose (the detail not being shown in the drawings). On the upper side of the tank 32 there is an opening 68 to which an annular rubber seat 34 is attached; on the underside of a lid 33 there is set aside on air inlet 36 that has been formed simultaneously with the lid 33. Extending into the tank by penetrating through opening 68 is a feeder or spindle 35. Regarding this spindle, there is a depression or recess 66 on its side at the central portion for introducing air into the tank from the air inlet 36 during a certain range of ascending stroke of the spindle. Attached to the lower end of the spindle is a valve 37 with a rubber packing 38 attached to its lower surface.

A spring 39 is provided around the spindle 35 in the space between the lid 33 and the valve, thereby plugging up opening 40 that has been provided on the underside of the water tank 32. A spindle lever 43 is pivotally connected to a pin 43' at the front portion of the handle 25.

A spindle arm 41 is pivotally connected to a pin 42 and is in engagement with the spindle lever 43. The tip of the spindle arm 41 is loosely coupled to the groove 44 at the upper end of the spindle. Upon pulling the spindle lever 43 with fingers in the direction "F" as shown by the arrow, the spindle 35 will go up, overcoming the elastic force of the spring 39. At the same time, the opening 40 opens, producing a clearance gap between the depression 66 in the spindle 35 and the rubber seat 34, thereby admitting the inflow of air from the air inlet 36 into the water tank 32 to cause the dripping down of a water drop W from the opening 40; nevertheless, upon a rise to the prescribed position of the spindle 35, the air inlet 36 will be shut off by the side surface of the lower side 69 of the depression in the spindle thereby stopping the inflow of air and, even though the opening 40 stays open, the water drops will cease to fall down. The spring is so biased that upon the releasing of the spindle lever 43, the spindle 35 is forced to come down by the action of the spring 39, causing the spindle 35 to tightly sit on the rubber seat 34, thereby plugging up the opening 40. The evaporation chamber 65 is formed by a cup-shaped metal plate 45 that is arranged underneath the above-mentioned unit that feeds water little by little. It is provided with a heater 46 on the underside of its bottom; and when a water drop W falls from the opening 40 into the evaporation chamber 65, this unit is so arranged that the water drop W vaporizes instantly.

There is a passage 47 for vapor following the evaporation chamber 65, that has been set up in combination with the tank 32; it is affixed to the upper part on the internal surface of the cover 29 by means of a flange 48 that projects the periphery of the upper rim of the tank 32.

Between the inner surface of the cover 29 and the tank 32 and the passage 47 is a gap 67.

Along the underside of the dryer wall 11 inside the upper part of the cover 29 is an outer nozzle 49, and on its inside there is set up through the medium of a gap 50 an inner nozzle 51, the rear end of the latter is coupled to the interior at an intermediate portion of the outer nozzle by an annular rim 52. In the respective outer ends 55 and 56 of the outer nozzle 49 and the inner nozzle 51, there are recesses or depressions 53 and 54, facing toward the inside, that prevent the outflow of water drops; in addition, the outer nozzle is so disposed as to project forward further than the inner nozzle. The rear end of the outer nozzle 49 is closed by a closing member 57; and the underside of the rear of the outer nozzle 49 is connected to the upper end of the aforementioned passage 47 through a connecting tube 58. An opening 59 for ventilation is formed in the outer nozzle, between the gap 50 and a space 70. The space 70 is connected to the outer portion by an opening 71. A drain hole 61 is formed in the lower part of the outer nozzle 49.

The vapor S produced in the evaporation chamber 65, after filling up the passage 47, passes through the inner nozzle 51 and becomes mixed with the air that has flowed in from the opening 59, subsequently being ejected to the outside from the outer nozzle 49.

If the heater 46 is functioning, with the fan 14 being kept in rotation at the same time, when the shutter 20 is closed, cold air C will pass through the ventilating port 31 and will be discharged to the outside from the outlet 30 after passing through the gap 67.

Figure 5:
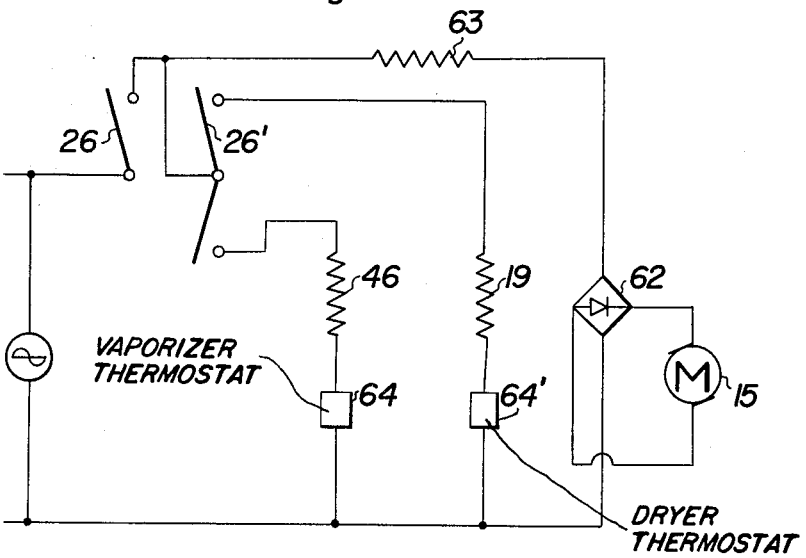
Figure 4:
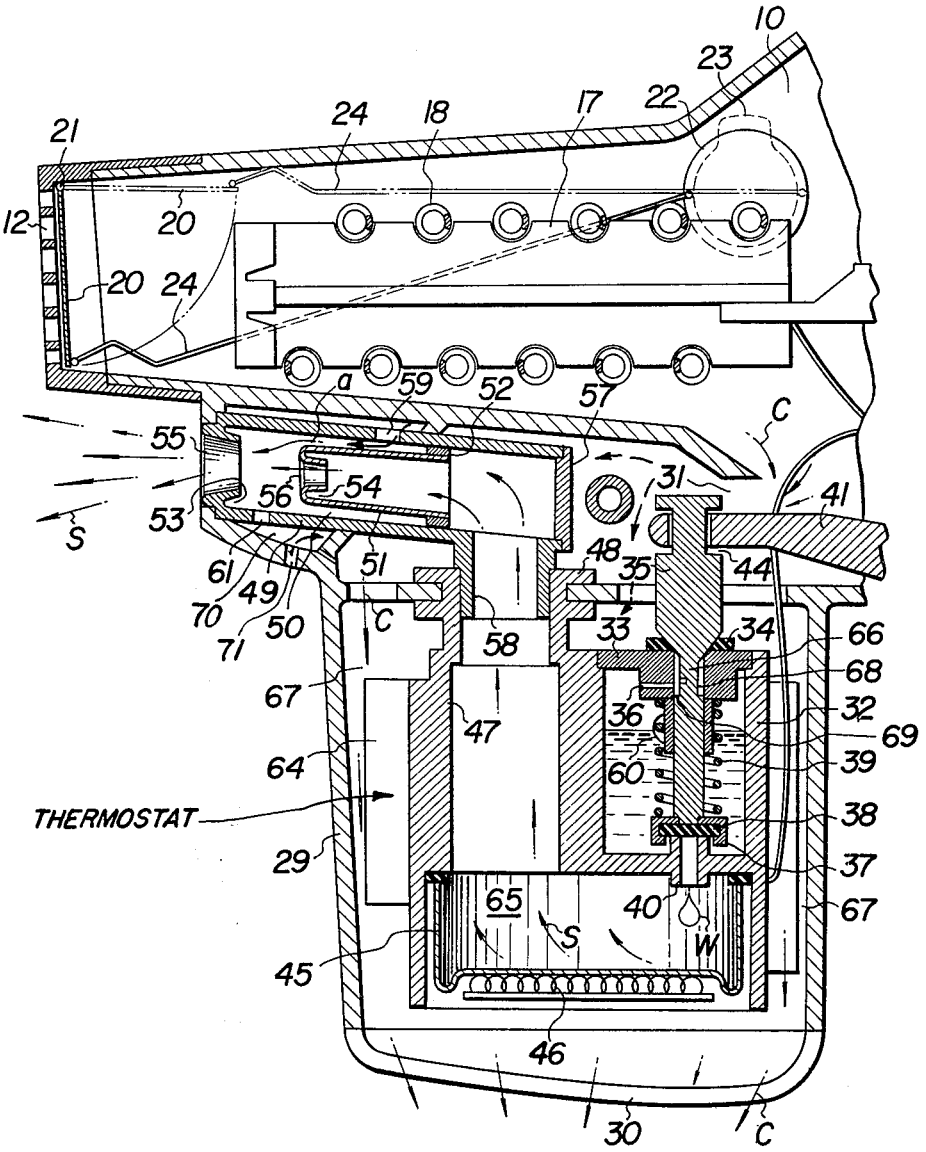
FIG. 4 is a cross-sectional view showing on an enlarged scale the essential parts of the dryer given in FIG. 3.

The circuit of FIG. 5 shows a rectifier 62, a voltage dropping resistance 63 and a pair of thermostats 64, 64'. When a switch 26 is shifted to the side of the resistance 63, a motor 15 will rotate; consequently, the fan 14 will turn, permitting the cold air C to be blown out from the main nozzle 12. Next, when switch 26' is shifted to the side of the heater 18, hot air is blown out.

And when the switch 26' is changed over to the side of heater 46, simultaneously with the ejection of vapor S, cold air C is discharged from the outlet 30.

In the case where vapor is ejected, with the switch 26' for the heater 46 side being kept "ON", when the lever is pulled after the lapse of about 1 minute the vapor can be ejected immediately; and also by repeatedly pulling the lever at prescribed times, a proper amount of vapor can be continuously ejected as desired. Thus, water drop W that has fallen into the evaporation chamber is vaporized almost instantly, the efficiency of the steam production is excellent and power consumption is small. Furthermore, as has been herein described, with the construction of the inner nozzle 51 and the outer nozzle 49, water drops are prevented from flowing out, allowing only steam to be ejected, by forming the depressions or recesses 54 and 53, that face toward the inside, along the circumference of the outer ends of the respective nozzles, it is very safe for use.

Moreover, with a shutter mechanism on the inside of the main nozzle 12, the overheating inside the cover 29 can be forestalled during the ejection of vapor through the discharge of cold air from the outlet 30, in the cover, by turning the fan 14, there is no likelihood of producing trouble even when kept continuously in operation.

In case vapor is not used, the dryer with the shutter 20 is kept in its open state, allows the ejection of hot air or cold air in the same way as for a conventional hair dryer.

It is to be observed therefore, that the present invention provides for a hair dryer which will not drip. Broadly stated, the hair dryer has a handle 25, an extended dryer chamber 10 with a rear portion set upon the handle in a plane substantially normal to the handle with a nozzle extending out from said rear portion with an upper air passage and a lower vapor passage, a tank 32 with upper and lower sections for holding liquid disposed under the nozzle.

At said rear portion are air drive means including air suction ports 13, fan means 14, driving air through the air and vapor passages, with heater means in the air passage, a shutter 20 at the front of the air passage including manual means 23 for operating the shutter.

In tank 32 are liquid outlet means 40 at the lower section thereof, a valve 37 and spring means 39 biasing the valve in the closed position over said outlet means, a feeder rod 68 connected to said valve 37 extending through said tank to said upper section and a spindle 41 connected to said feeder rod at said upper section including a trigger 43 disposed alongside the handle for lifting the valve 37 against the force of the spring 39.

Disposed under said liquid outlet means 40 is a vaporization chamber including a heater 46 therein and a vapor duct 47 extending from said vaporization chamber to said nozzle vapor passage.

In said nozzle vapor passage are inner and outer nozzle means 51, 49 both with nozzle outer ends said inner nozzle means having an inner end coupled to duct 47, the inner nozzle means being within the outer nozzle means, the outer end of said inner nozzle means being inward from and separated from the outer end of the outer nozzle means and inwardly disposed annular recesses 53, 54 in both said nozzle outer ends thereby preventing liquid drops from falling from said outer nozzle outer end.

I claim:

1. A hair dryer comprising in combination:

a. a grip handle (25), with an upper section, an elongated upper chamber with middle and rear sections, said rear section being connected to and disposed above said upper section, in a plane substantially normal to said drip handle, a suction opening (13) in said rear section, a dryer chamber (10) in said middle section, a longitudinal main nozzle (12) with an outlet extending frontwards of said dryer chamber (10);

b. air drive means (14, 15) in said rear section disposed to suction air through said suction opening (13) into said dryer chamber (10) and drive the air out of said main nozzle (12), heater means (18) extending longitudinally across said main nozzle;

c. a housing (29) with a front and rear sides; disposed under said main nozzle, a tank (32) at the rear side of said housing, for holding liquid, a nozzle vapor passage at the front side of said housing under said main nozzle, a connecting aperture (31) between said main nozzle (12) and said nozzle vapor passage, to allow ventilating air to flow into the housing for passage through said housing to a ventilating air outlet provided therein, liquid outlet means (40) in said tank (32), a valve (37) and a spring means (39) biasing the valve in the closed position in said tank, feeder means connected to said valve with a trigger (43) disposed alongside said handle for lifting said valve (37) against the force of the spring (39), a vaporization chamber (65) with a top disposed under said liquid outlet means (40), a heater (46) at the bottom of said chamber (65) and a vapor duct (47) extending from said vaporization chamber (65) to said nozzle vapor passage;

d. inner and outer longitudinal nozzle means (51, 49) in said nozzle vapor passage both with nozzle discharge ends, said outer nozzle means (49) surrounding said inner nozzle means (51) and spaced by a gap from said inner nozzle means, said outer nozzle means nozzle discharge end projecting further than said inner nozzle means (51) nozzle discharge end, said inner nozzle means having an inlet end coupled to said duct (47) said inner nozzle means being within said outer nozzle and longitudinally smaller than said outer nozzle means, the nozzle discharge end of said inner nozzle means being within the outer nozzle means and separated from the nozzle discharge end of the outer nozzle means, inwardly disposed annular flange recesses (53, 54) in both said nozzle discharge ends for preventing liquid drops from falling from said outer nozzle discharge end; and, e. switch means (26) and a two position switch (26') on said handle, a first circuit connecting said switch means (26) and said air drive means (14, 15) and a second circuit selectively connecting said switch (26') in one position to said heater means (18) and in a second position to said heater (46).

2. A hair dryer comprising in combination:

a. a handle (25), an extended dryer chamber (10) with a middle and rear portion, said rear portion being set upon said handle in a plane substantially normal to said handle, said chamber having a nozzle extending out from said middle portion, said chamber and nozzle defining an upper air passage, air drive means including air suction ports (13), fan means (14) driven by a driver (15) at said rear portion driving air through said upper air passage, heater means (18) in said air passage;

b. a housing (29) with front and rear sides having a vapor nozzle under said upper air passage, at said front side, a tank (32) with upper and lower sections at said rear side, a connecting aperture (31) between said nozzle (12) and said housing to allow ventilating air to flow into the housing to ventilating air passages therein and said housing having a ventilating air outlet through which air flowing through the ventilating air passages is vented to the atmosphere.

c. liquid outlet means (40) in said tank (32) at said lower section thereof, a valve (37) and spring means (39) biasing the valve in the closed position over said outlet means, a feeder rod (68) connected to said valve (37) extending through said tank to said upper section and a spindle (41) connected to said feeder rod at said upper section including a trigger (43) disposed alongside said handle for lifting said valve (37) against the force of the spring (39);

d. a vaporization chamber with a top disposed under said liquid outlet means (40), a heater (46) at the bottom of said vaporization chamber and a vapor duct (47) extending from said vaporization chamber to said vapor nozzle;

e. longitudinal inner and outer nozzle means (51, 49) each with a separate discharge ends in said vapor nozzle with a gap therebetween, both with nozzle outer ends, said inner nozzle means having an inner end coupled to said duct (47), said inner nozzle means being longitudinally within said outer nozzle means, the discharge end of said inner nozzle means being inward from, and separated from the discharge end of the outer nozzle means, and inwardly disposed annular recesses (53, 54) in both said nozzle discharge ends to prevent liquid drops from falling from said outer nozzle means outer end; and, f. means for selectively activating the fan means (14), heater means (18), and heater (46).

* * * * *